US010894680B2

(12) United States Patent
Nishizaka et al.

(10) Patent No.: US 10,894,680 B2
(45) Date of Patent: Jan. 19, 2021

(54) MULTIFEED DETECTION DEVICE AND IMAGE READING APPARATUS

(71) Applicant: SEIKO EPSON CORPORATION, Tokyo (JP)

(72) Inventors: Katsuhiko Nishizaka, Kitakyushu (JP); Daisuke Honda, Munakata (JP)

(73) Assignee: Seiko Epson Corporation, Tokyo (JP)

( * ) Notice: Subject to any disclaimer, the term of this patent is extended or adjusted under 35 U.S.C. 154(b) by 92 days.

(21) Appl. No.: 16/113,615

(22) Filed: Aug. 27, 2018

(65) Prior Publication Data

US 2019/0062091 A1 Feb. 28, 2019

(30) Foreign Application Priority Data

Aug. 30, 2017 (JP) ..... 2017-165693

(51) Int. Cl.
*B65H 7/12* (2006.01)
*B65H 3/06* (2006.01)

(52) U.S. Cl.
CPC ..... *B65H 7/125* (2013.01); *B65H 3/0669* (2013.01); *B65H 2402/46* (2013.01); *B65H 2553/30* (2013.01); *B65H 2557/61* (2013.01); *B65H 2557/64* (2013.01)

(58) Field of Classification Search
CPC ..... B65H 7/12; B65H 7/125; B65H 2553/30
See application file for complete search history.

(56) References Cited

U.S. PATENT DOCUMENTS

| | | | | |
|---|---|---|---|---|
| 7,891,663 | B2 * | 2/2011 | Tsuruoka | B65H 7/12 271/259 |
| 8,272,639 | B2 * | 9/2012 | Simonis | B65H 7/125 271/258.01 |
| 9,465,021 | B2 * | 10/2016 | Schulz | B65H 7/125 |
| 9,769,329 | B2 | 9/2017 | Tajima et al. | |
| 2014/0311236 | A1 * | 10/2014 | Schulz | G01B 21/08 73/159 |
| 2015/0324893 | A1 * | 11/2015 | Langen | B65B 61/26 705/26.81 |
| 2017/0228956 | A1 * | 8/2017 | You | G07D 7/164 |

FOREIGN PATENT DOCUMENTS

| | | | |
|---|---|---|---|
| JP | 2012-144307 | A | 8/2012 |
| JP | 2013-010599 | A | 1/2013 |
| JP | 2014-047075 | A | 3/2014 |
| JP | 2015-147659 | A | 8/2015 |
| JP | 2017-075035 | A | 4/2017 |
| JP | 2017-088269 | A | 5/2017 |
| JP | 2017-109858 | A | 6/2017 |
| JP | 2018-193167 | A | 12/2018 |

* cited by examiner

*Primary Examiner* — Thomas A Morrison
(74) *Attorney, Agent, or Firm* — Workman Nydegger

(57) ABSTRACT

A multifeed detection device that detects multifeed by using an ultrasonic wave includes an ultrasonic emitting unit and an ultrasonic receiving unit arranged to oppose each other with a medium transport path interposed therebetween; judges occurrence of multifeed of media based on a detection intensity of an ultrasonic wave received by the ultrasonic receiving unit, and a multifeed threshold for judging multifeed of media; and acquires first information that is information relating to adjustment for the multifeed threshold, and second information for specifying that the first information is the information relating to the adjustment for the multifeed threshold, from a calibration sheet holding the first information and the second information.

4 Claims, 14 Drawing Sheets

MULTIFEED DETECTION DEVICE AND IMAGE READING APPARATUS

BACKGROUND

1. Technical Field

The present invention relates to a multifeed detection device that detects multifeed of media, and an image reading apparatus including the multifeed detection device.

2. Related Art

A scanner, which is an example of an image reading apparatus, in some cases has an ultrasonic sensor for detecting multifeed of documents (media) to be read by a reader. The ultrasonic sensor includes an ultrasonic emitting unit that is provided on one of upper and lower sides of a document to be transported in a document transport path and that emits an ultrasonic wave, and an ultrasonic receiving unit that is provided on the other side and that receives an ultrasonic wave emitted from the ultrasonic emitting unit.

The intensity of an ultrasonic wave received by the ultrasonic receiving unit is high when multifeed of documents does not occur, and is low when multifeed of documents occurs. Thus, a basic method of detecting multifeed is setting a multifeed judgment threshold, and making a judgment as non-multifeed if the intensity of an ultrasonic wave is equal to or more than the multifeed judgment threshold or making a judgment as multifeed if the intensity of an ultrasonic wave is less than the multifeed judgment threshold.

However, the intensity of an ultrasonic wave received by the ultrasonic receiving unit varies depending on the environment, such as temperature, humidity, and atmospheric pressure, under which the apparatus is actually used. The variation in the intensity of an ultrasonic wave may result in incorrect detection of multifeed. Thus, it is desirable to perform processing of correcting the multifeed judgment threshold to a proper value corresponding to a change in the environment (hereinafter, occasionally referred to as "calibration").

JP-A-2017-109858 discloses a multifeed detection device that corrects the multifeed judgment threshold to a proper value corresponding to a change in the environment.

In the multifeed detection device described in JP-A-2017-109858, "a first offset value," "a first sheet passage signal value," "a first threshold," and "a first sheet non-passage signal value" are previously stored in a storage device before factory shipment (paragraph 0066 in JP-A-2017-109858). While the meaning of the respective values is described in detail in JP-A-2017-109858, "the first sheet passage signal value" is an ultrasonic signal value when a sheet for threshold calculation is passed (paragraphs 0058 to 0060 in JP-A-2017-109858).

When the apparatus is used, "a second offset vale" and "a second sheet non-passage signal value" are acquired by performing ultrasonic sensor adjustment processing. While the meaning of the respective values is described in detail in JP-A-2017-109858, "the second offset value" corresponds to "the first offset value" acquired before factory shipment, and "the second sheet non-passage signal value" corresponds to "the first sheet non-passage signal value" acquired before factory shipment.

The multifeed judgment threshold ("the second threshold" in JP-A-2017-109858) to be used when the apparatus is used is obtained based on "the first sheet passage signal value" and "the second offset value" (paragraph 0092 in JP-A-2017-109858), and then the multifeed judgment threshold is corrected based on "the first sheet non-passage signal value" and "the second sheet non-passage signal value" (paragraph 0094 in JP-A-2017-109858).

With the multifeed detection device described in JP-A-2017-109858, a user does not need transport a sheet for threshold calculation to calculate "the second threshold," and convenience of the user increases. However, since "the second threshold" is calculated based on "the first sheet passage signal value" acquired under the environment different from the use environment of the user, and a doubt arises in validity of "the second threshold."

To address the doubt, the calibration is desirably performed by using a sheet for threshold calculation under the user environment even when the convenience of the user decreases. However, a correct sheet suitable for the calibration under the user environment may not be always used. Thus a doubt still arises in validity of a threshold obtained by the calibration. This is a first problem of related art.

In addition, while the multifeed detection device described in JP-A-2017-109858 uses "the first sheet non-passage signal value" and "the second sheet non-passage signal value" for correcting "the second threshold," the values are obtained from an ultrasonic signal with a specific amplitude. For example, when the intensity of an ultrasonic wave is adjusted by using a voltage to be applied to the ultrasonic emitting unit, a doubt may arise in validity of "the second threshold" if a deviation occurs between an application voltage at acquisition of "the first sheet non-passage signal value" (before factory shipment) and an application voltage at acquisition of "the second sheet non-passage signal value" (during use by user). This is a second problem of related art.

SUMMARY

An advantage of some aspects of the invention is to provide an image reading apparatus capable of solving at least one of the first and second problems.

According to a first aspect of the invention, a multifeed detection device includes an ultrasonic emitting unit that is arranged in a medium transport path through which a medium is transported, and that emits an ultrasonic wave; an ultrasonic receiving unit that is arranged to oppose the ultrasonic emitting unit with the medium transport path interposed therebetween, and that receives the ultrasonic wave emitted from the ultrasonic emitting unit; a multifeed judgment unit that judges occurrence of multifeed of media based on a detection intensity of the ultrasonic wave received by the ultrasonic receiving unit, and a multifeed threshold for judging multifeed of media; and an information acquisition unit that acquires first information that is information relating to adjustment for the multifeed threshold, and second information for specifying that the first information is the information relating to the adjustment for the multifeed threshold, from a calibration sheet holding the first information and the second information.

With the aspect, calibration is performed by using the calibration sheet under a user environment. Thus, a proper value corresponding to the user environment can be used as a threshold for multifeed judgment (multifeed threshold), and multifeed can be properly judged. The calibration sheet holds the first information that is the information relating to the adjustment for the multifeed threshold and the second information for specifying that the first information is the information relating to the adjustment for the multifeed threshold. Thus, the validity of the multifeed threshold acquired by the calibration is ensured and proper multifeed judgment can be reliably performed.

It is preferable that the multifeed judgment unit is configured to acquire an upper-limit threshold that is an upper-limit value of the multifeed threshold, and a lower-limit threshold that is a lower-limit value of the multifeed threshold held in a storage that stores information; the first information includes an upper-limit detection value that is an upper-limit value of the detection intensity, and a lower-limit detection value that is a lower-limit value of the detection intensity when the ultrasonic emitting unit emits an ultrasonic wave while the calibration sheet is interposed between the ultrasonic emitting unit and the ultrasonic receiving unit; and the multifeed judgment unit determines the multifeed threshold by using the upper-limit threshold and the lower-limit threshold, based on a position between the upper-limit detection value and the lower-limit detection value of the detection intensity when the ultrasonic emitting unit emits the ultrasonic wave while the calibration sheet is interposed between the ultrasonic emitting unit and the ultrasonic receiving unit.

In this case, the storage of the multifeed detection device stores the upper-limit threshold and the lower-limit threshold, the calibration sheet holds the upper-limit detection value and the lower-limit detection value, and the multifeed threshold is determined by using the upper-limit threshold and the lower-limit threshold, based on the position between the upper-limit detection value and the lower-limit detection value of the detection intensity when the calibration sheet is detected. Thus, the multifeed threshold can be determined by a simple method. Moreover, the upper-limit threshold and the lower-limit threshold are stored in the storage of the multifeed detection device. Thus, even when the upper-limit threshold and the lower-limit threshold are adjusted depending on the situation (as the result, even when the multifeed threshold is set to be relatively high or low), the adjustment can be properly made.

It is preferable that the multifeed judgment unit stops processing and makes an alert when the detection intensity falls outside a range from the upper-limit detection value to the lower-limit detection value.

In this case, the multifeed judgment unit stops the processing and makes the alert when the detection intensity falls outside the range from the upper-limit detection value to the lower-limit detection value. Thus, improper setting of the multifeed threshold and improper judgment based on the improper setting can be prevented.

It is preferable that when the multifeed judgment unit detects multifeed of media continuously a predetermined number of times, the multifeed judgment unit makes a notification of urging execution of calibration processing using the calibration sheet.

In this case, when the multifeed judgment unit detects multifeed of media continuously the predetermined number of times, the multifeed judgment unit makes the notification of urging execution of the calibration processing using the calibration sheet. Thus, a detection failure resulting from the improper multifeed threshold is expected to be reduced.

According to a second aspect of the invention, a multifeed detection device includes an ultrasonic emitting unit that is arranged in a medium transport path through which a medium is transported, and that emits an ultrasonic wave; an ultrasonic receiving unit that is arranged to oppose the ultrasonic emitting unit with the medium transport path interposed therebetween, and that receives the ultrasonic wave emitted from the ultrasonic emitting unit; a multifeed judgment unit that judges occurrence of multifeed of media based on a detection intensity of the ultrasonic wave received by the ultrasonic receiving unit, and a multifeed threshold for judging multifeed of media; and a storage that stores an initial multifeed threshold that is an initial value of the multifeed threshold. The storage stores, as a first slope value, a slope value acquired while a medium is not present between the ultrasonic emitting unit and the ultrasonic receiving unit under an environment to which the initial multifeed threshold is applied, for a slope value of a proportional expression that expresses a relationship between an intensity of an ultrasonic wave emitted from the ultrasonic emitting unit and the detection intensity; the multifeed judgment unit is configured to execute a calibration mode that acquires a second slope value as the slope value while a medium is not present between the ultrasonic emitting unit and the ultrasonic receiving unit under a use environment; and the initial multifeed threshold is changed based on a ratio of the first slope value to the second slope value, and used as the multifeed threshold.

The inventor has focused on that the intensity of an ultrasonic wave emitted from the ultrasonic emitting unit and the detection intensity of an ultrasonic wave received by the ultrasonic receiving unit have a proportional relationship under a predetermined condition, and thus has provided a configuration as follows. For example, a slope (first slope value) of the proportional expression is acquired in an assembly process of the apparatus, and the first slope value and the initial multifeed threshold are stored in the storage.

Under a use environment of the apparatus, the calibration mode is executed, and a second slope value is acquired under the use environment of the actual apparatus.

The relationship between the air density and the altitude (elevation) has substantially a proportional relationship in an altitude range (for example, about 0 to 3000 m) in which the apparatus is practically used. Thus, by applying the ratio of the first slope value to the second slope value to the multifeed threshold, a multifeed threshold suitable for the use environment of the actual apparatus can be obtained.

With this aspect, the multifeed threshold is changed based on the slope of the proportional expression that expresses the relationship between the intensity of an ultrasonic wave emitted from the ultrasonic emitting unit and the detection signal. That is, the multifeed threshold is determined not based on only a single ultrasonic intensity, but the multifeed threshold is determined based on a plurality of ultrasonic intensities. Thus, reliability of the corrected multifeed threshold is increased and more proper multifeed judgment can be performed.

It is preferable that when the multifeed judgment unit detects multifeed of media continuously a predetermined number of times, the calibration mode is executed.

In this case, when the multifeed judgment unit detects multifeed of media continuously the predetermined number of times, the calibration mode is executed. Thus, a detection failure resulting from the improper multifeed threshold is expected to be reduced.

It is preferable that a detection signal of an ultrasonic wave received by the ultrasonic receiving unit is input to a receiving circuit in which a plurality of amplifiers are connected in series; and the multifeed judgment unit acquires the slope value based on the detection signal transmitted from an amplifier located upstream of a last amplifier among the plurality of amplifiers.

With the receiving circuit in which the plurality of amplifiers are connected in series, the intensity of the detection signal output from the last amplifier among the plurality of amplifiers saturates due to amplification, and the proper slope value may not be acquired. Therefore, in this case, the multifeed judgment unit acquires the slope value based on the detection signal transmitted from the amplifier located upstream of the last amplifier among the plurality of amplifiers, and thus the proper slope value a can be acquired.

According to a third aspect of the invention, an image reading apparatus includes a reading device that reads a surface of a medium; and the multifeed detection device of the first aspect.

With this aspect, the image reading apparatus can provide advantages similar to those of any of the above-described first to sixth aspects.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of an image reading apparatus including a multifeed detection device according to the invention is described below. This embodiment exemplifies a document scanner (hereinafter, merely referred to as scanner 1) that can read at least one surface of front and back surfaces of a document, which is an example of a medium.

Multifeed Detection Device

Figure 1:
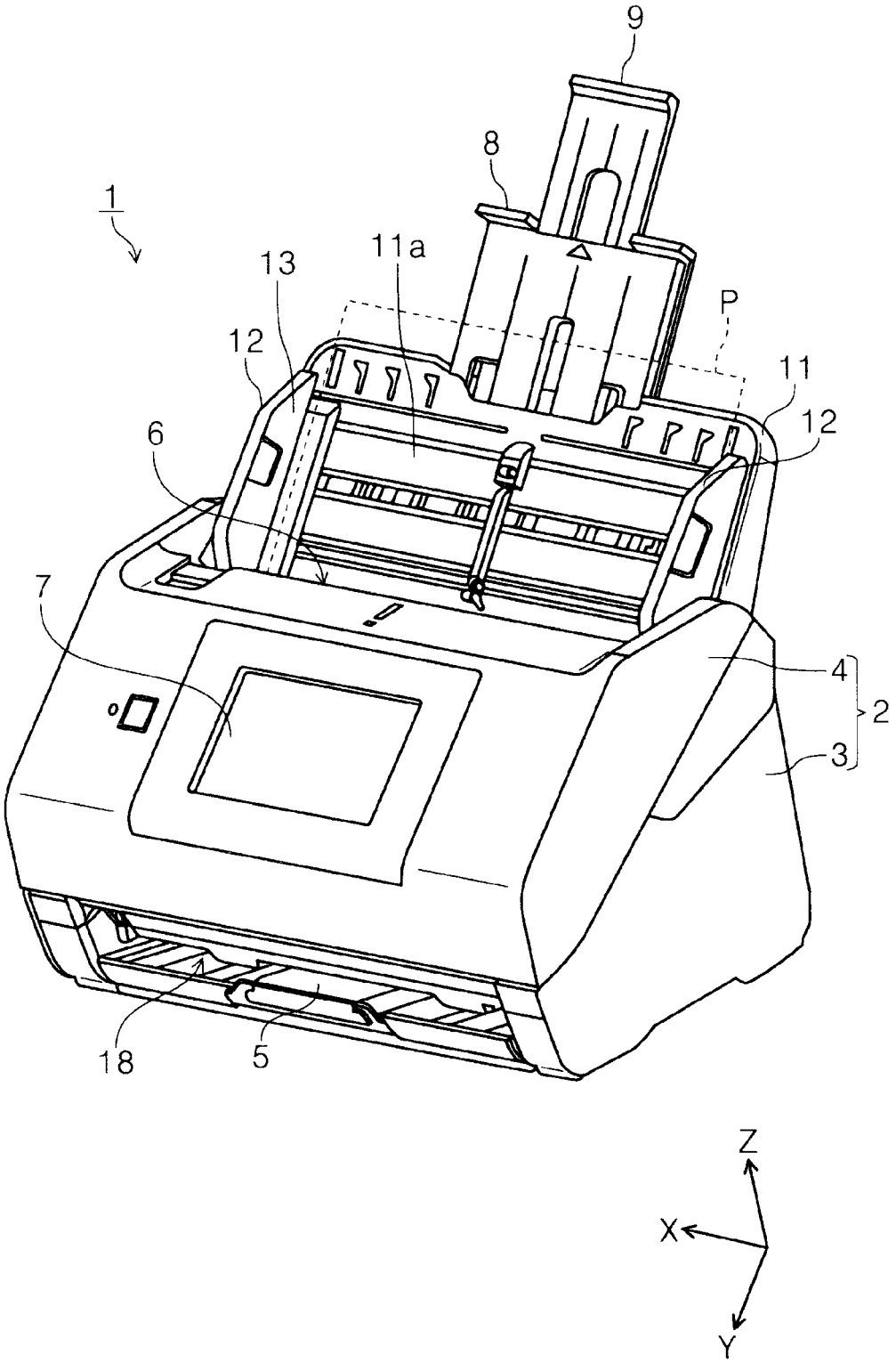
FIG. 1 is an external perspective view showing a scanner according to the invention.
Figure 2:
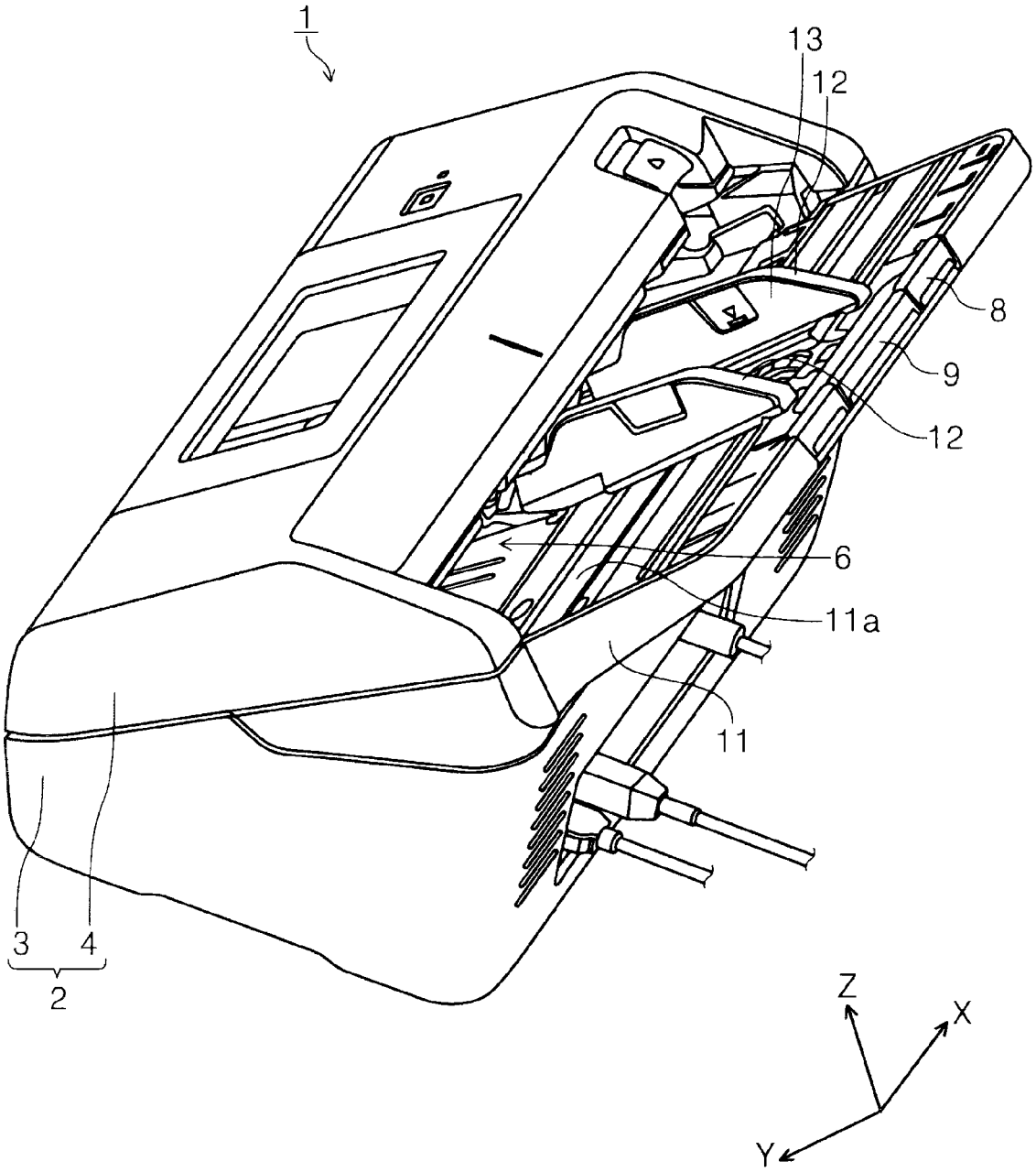
FIG. 2 is a perspective view showing the scanner according to the invention when viewed at an angle different from FIG. 1.
Figure 3:
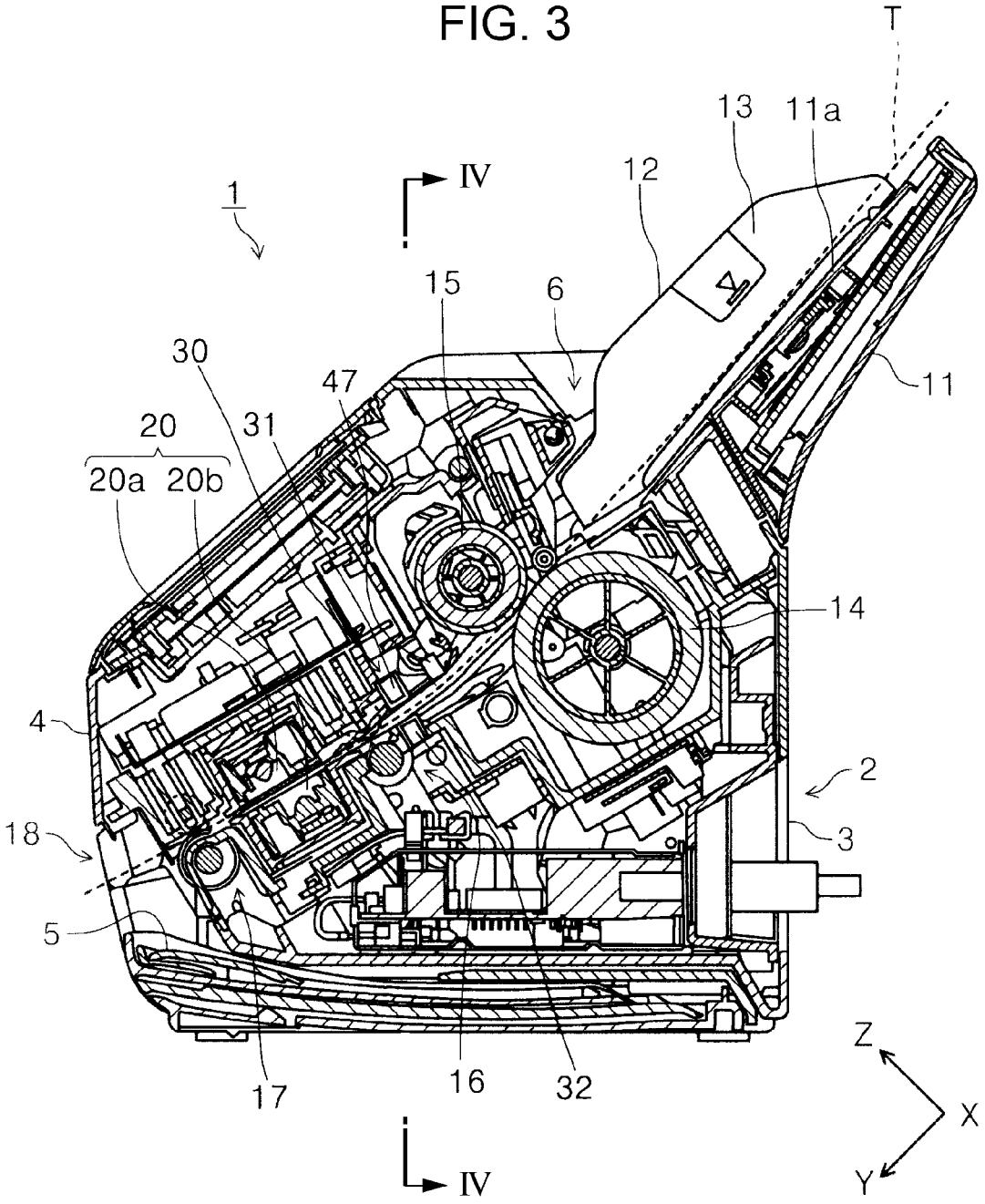
FIG. 3 is a side sectional view showing a document transport path in the scanner according to the invention.
Figure 4:
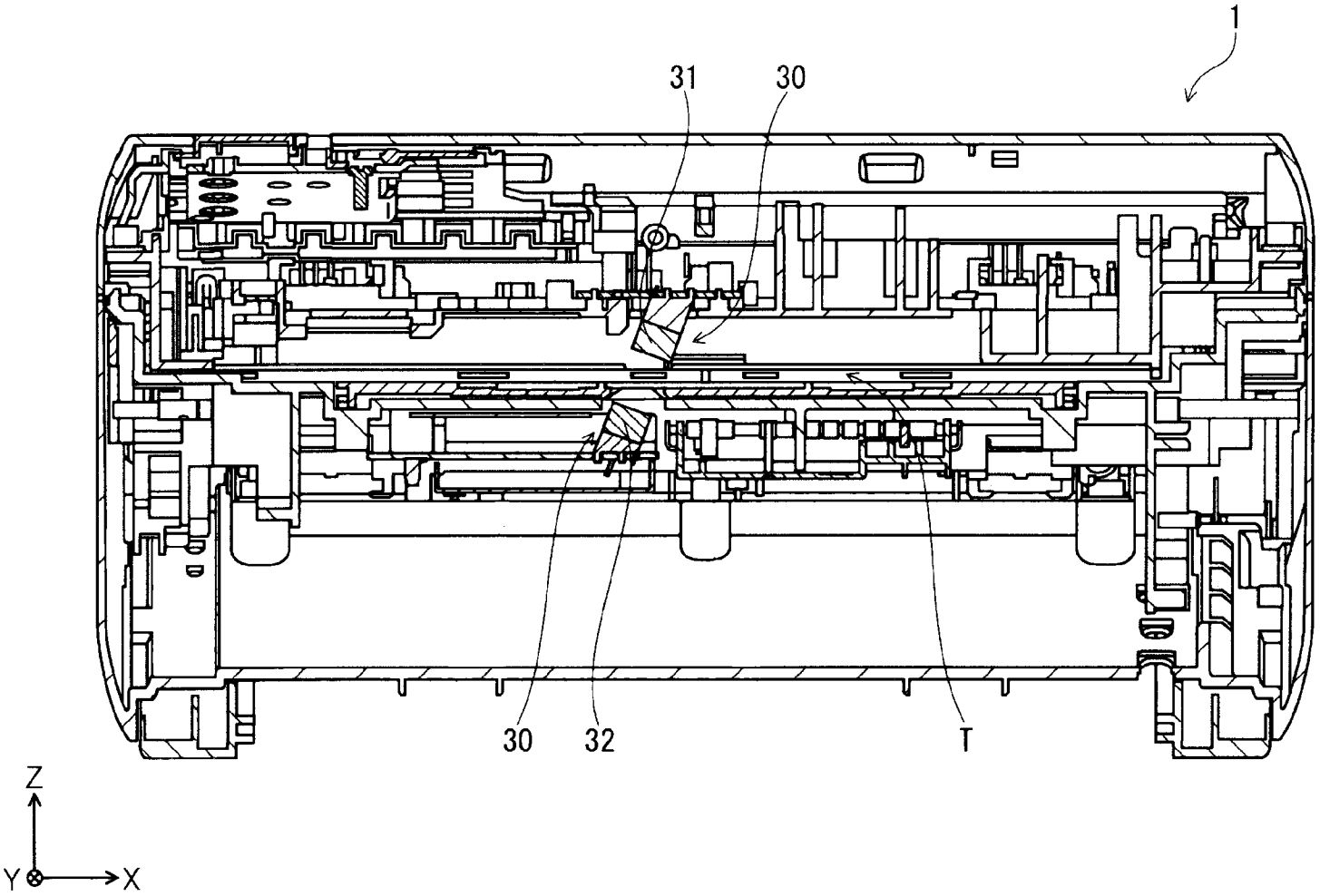
FIG. 4 is a sectional view taken along line IV-IV in FIG. 3.

FIG. 1 is an external perspective view showing a scanner according to the invention. FIG. 2 is a perspective view showing the scanner according to the invention when viewed at an angle different from FIG. 1. FIG. 3 is a side sectional view showing a document transport path in the scanner according to the invention. FIG. 4 is a sectional view taken along line VI-VI in FIG. 3.

Figure 5:
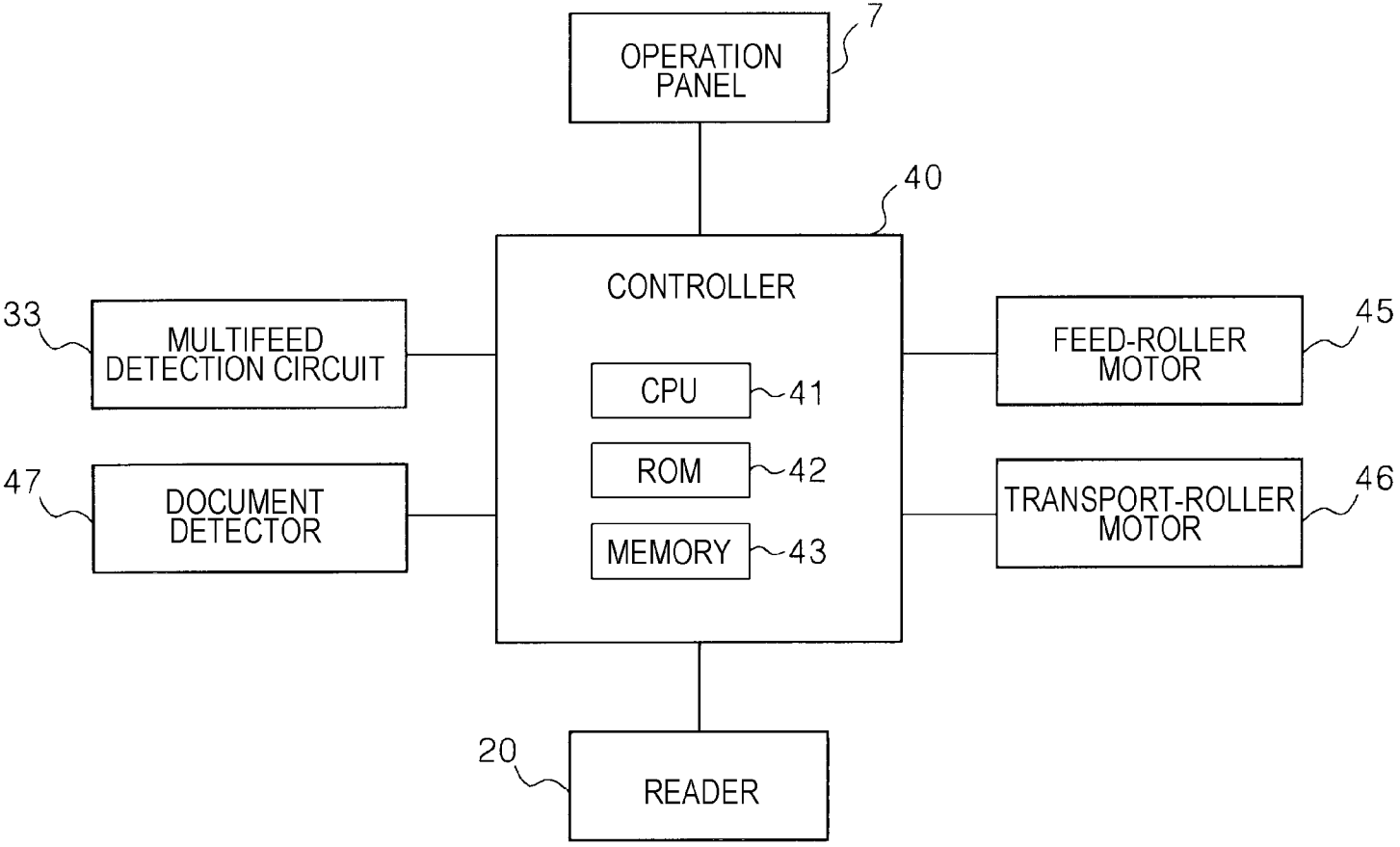
FIG. 5 is a block diagram showing a control system of the scanner according to the invention.
Figure 6:
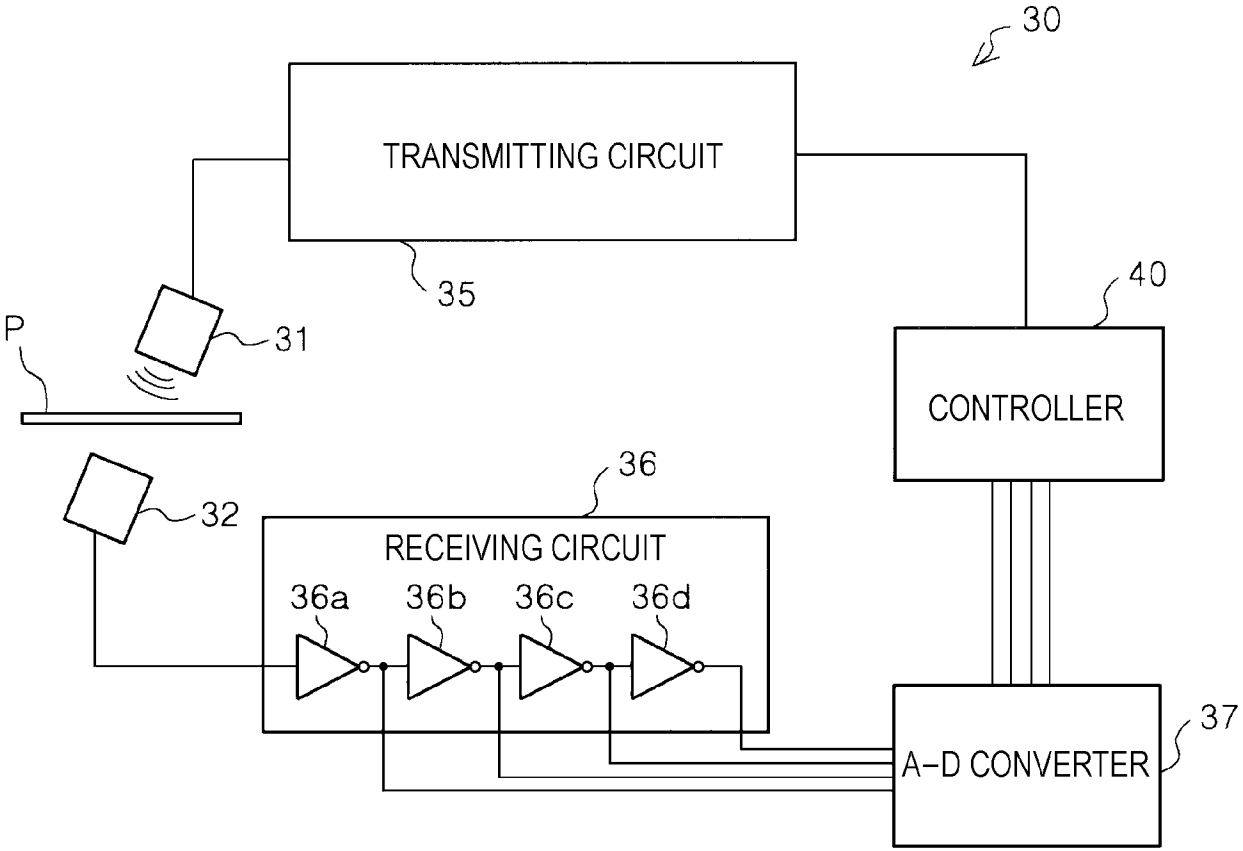
FIG. 6 is a block diagram of a multifeed detection device according to the invention.
Figure 7:
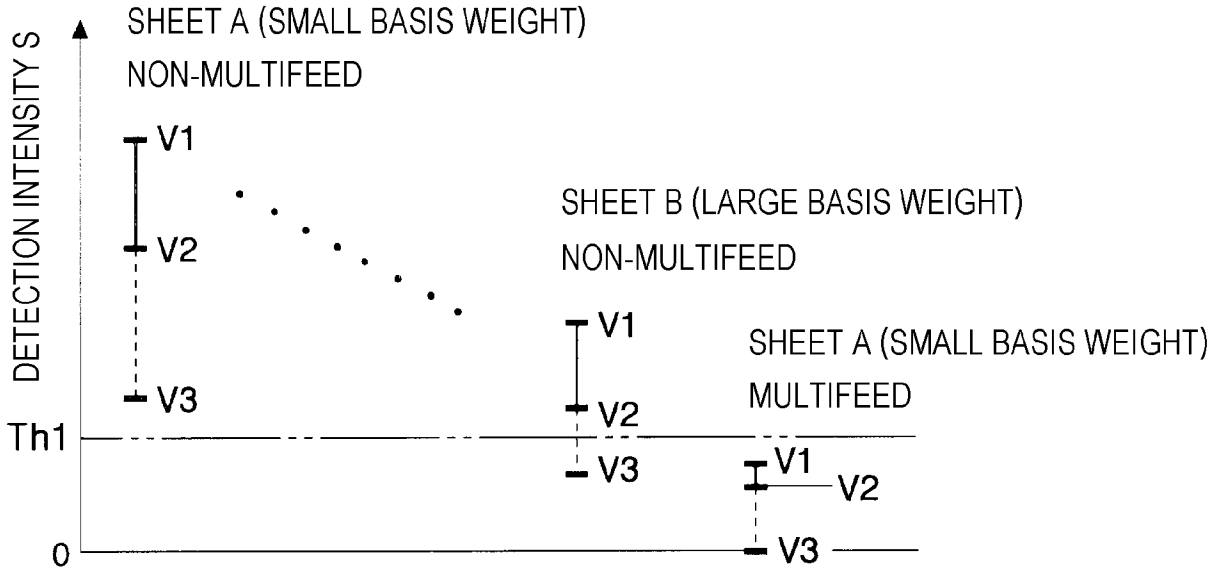
FIG. 7 is a graph schematically showing the relationship between the variation in detection intensity of multifeed detection and the type of sheets.
Figure 8:
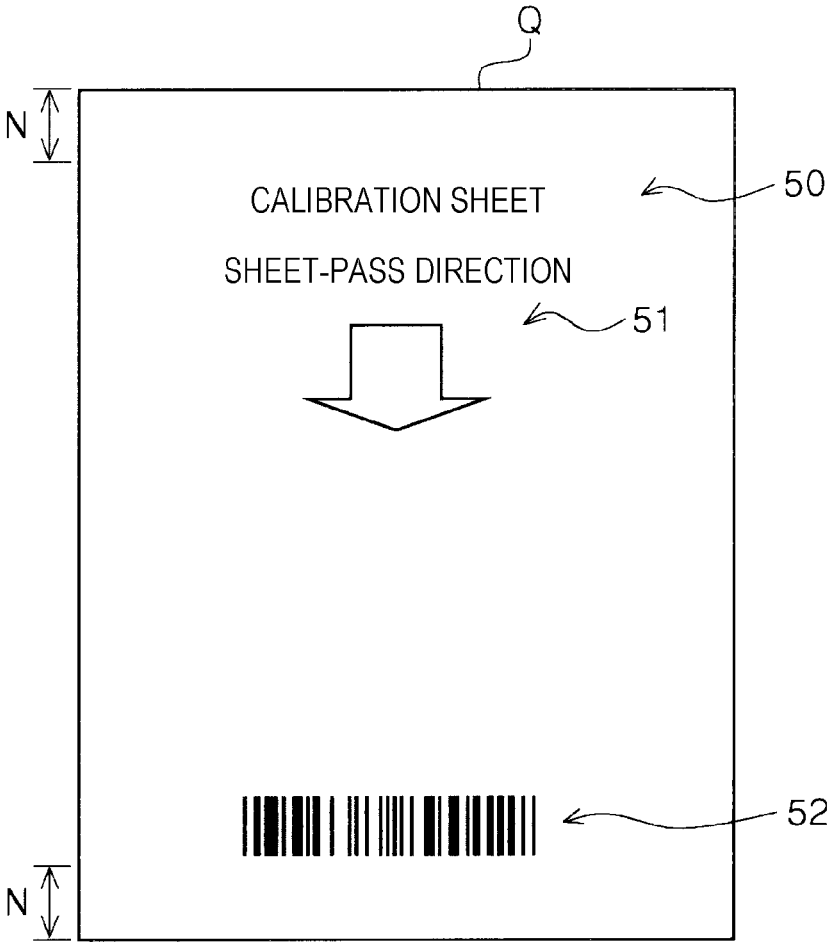
FIG. 8 is a plan view showing an embodiment of a calibration sheet.
Figure 9:
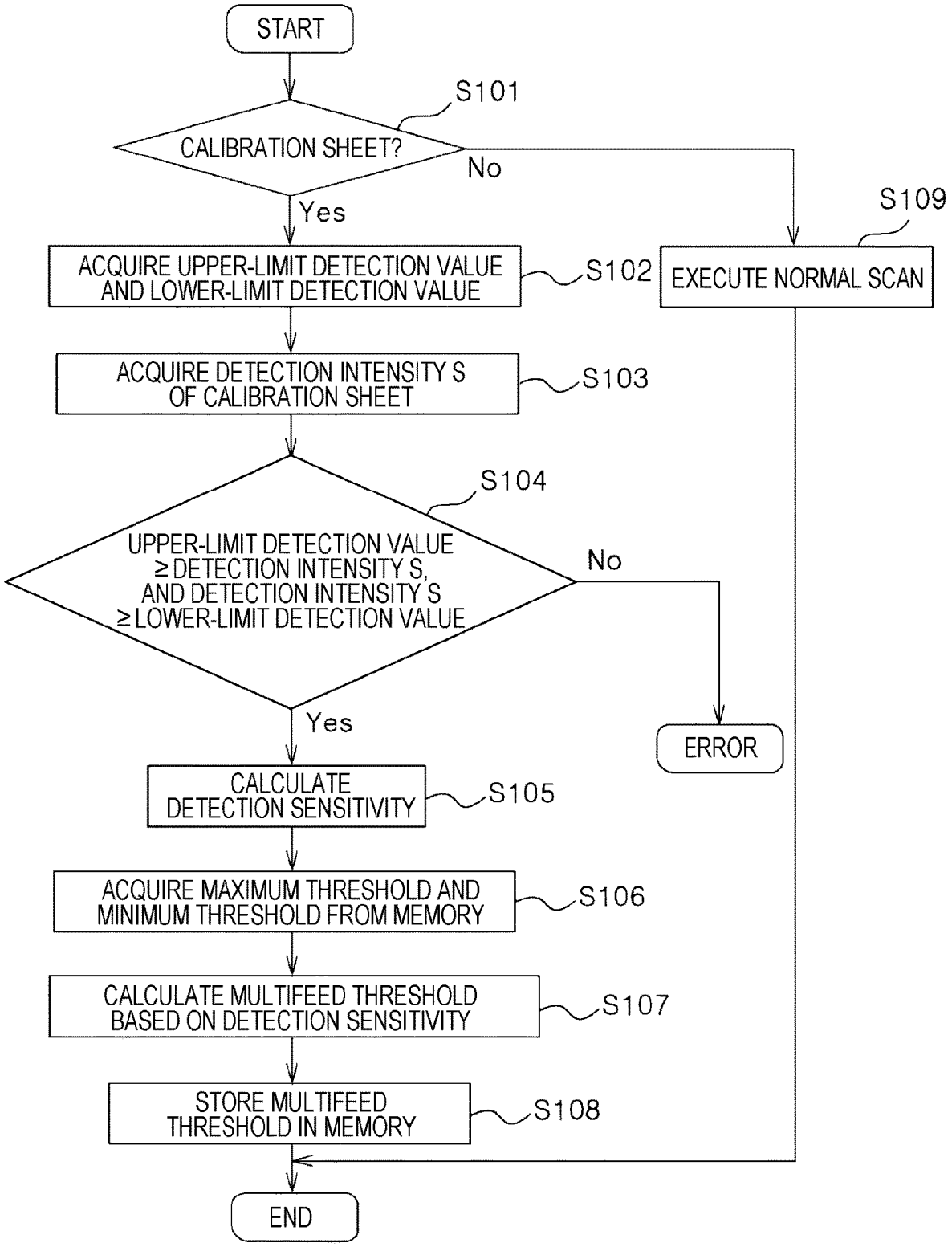
FIG. 9 is a flowchart showing a flow of multifeed detection calibration using the calibration sheet.
Figure 10:
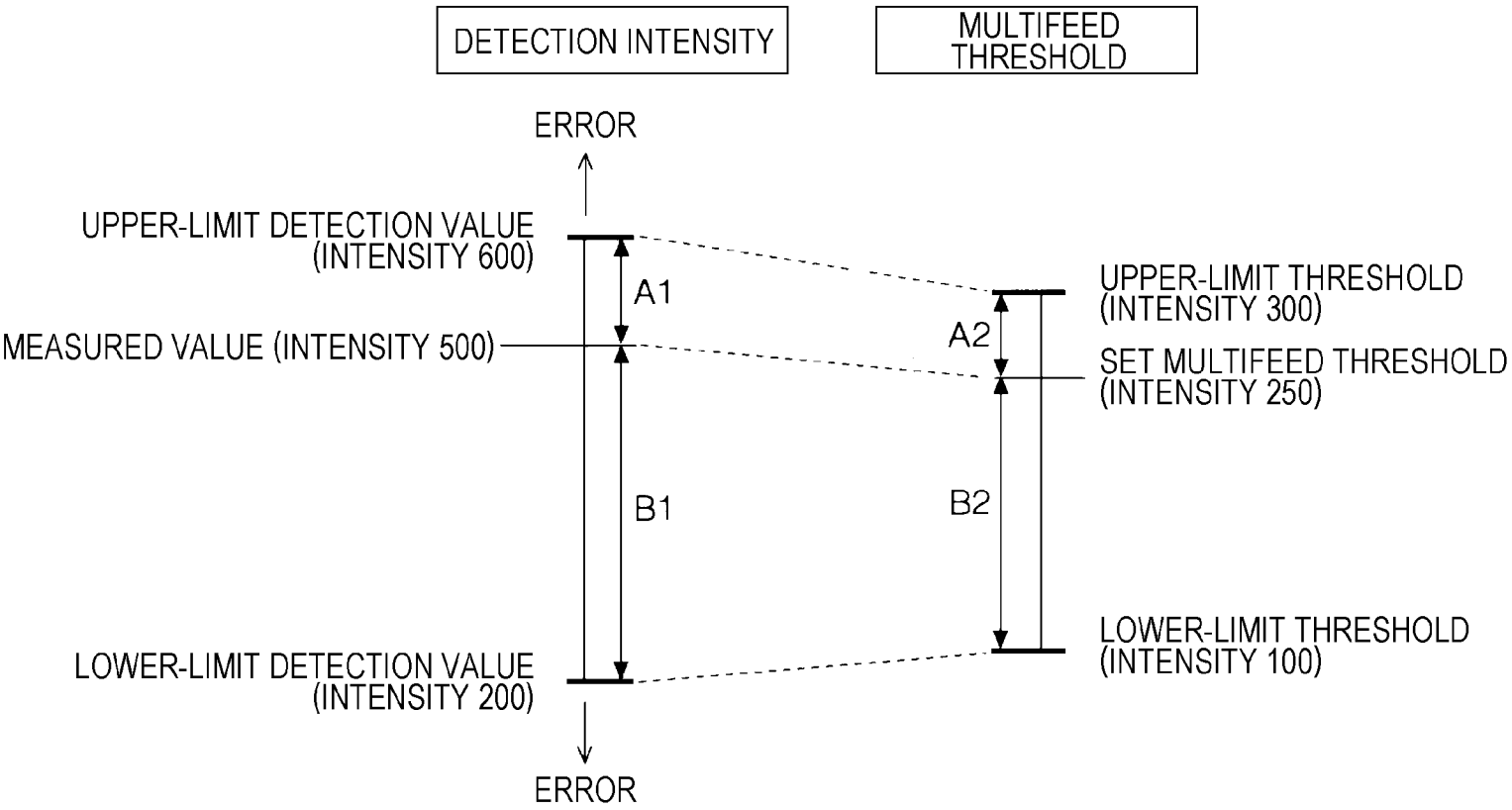
FIG. 10 schematically illustrates the relationship between the calibration detection value and the multifeed threshold.

FIG. 5 is a block diagram showing a control system of the scanner according to the invention. FIG. 6 is a block diagram of a multifeed detection device according to the invention. FIG. 7 is a graph schematically showing the relationship between the variation in detection intensity of multifeed detection and the type of sheets. FIG. 8 is a plan view showing an embodiment of a calibration sheet. FIG. 9 is a flowchart showing a flow of multifeed detection calibration using the calibration sheet. FIG. 10 schematically illustrates the relationship between the calibration detection value and the multifeed threshold.

Figure 11:
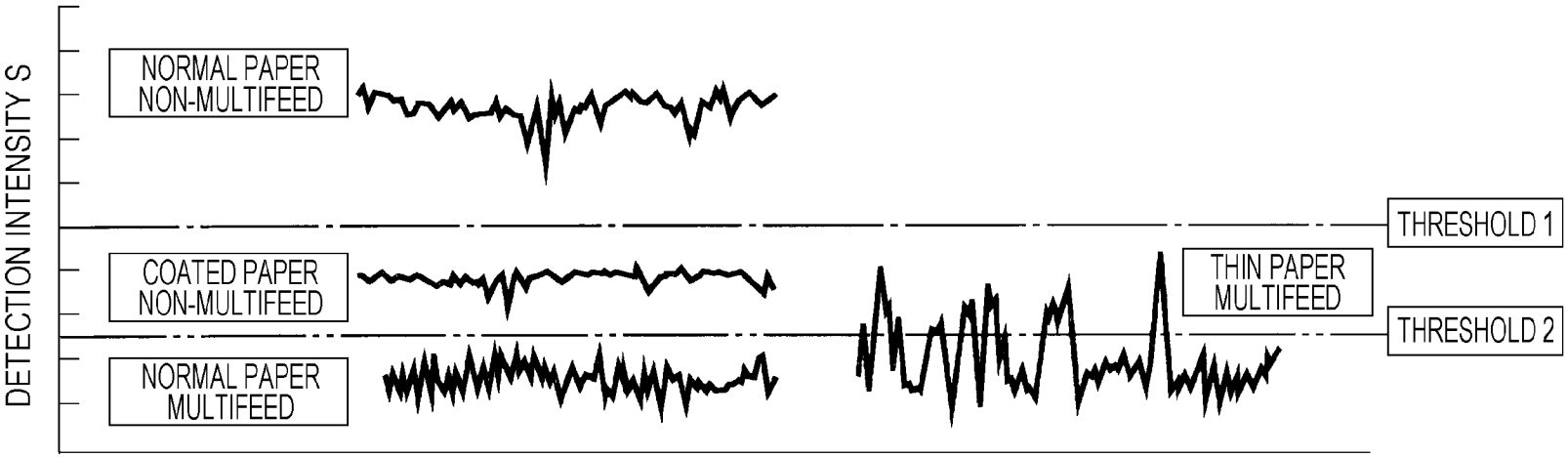
FIG. 11 is a graph showing an example of the relationship between the multifeed threshold and the detection intensity of each of coated paper, normal paper, and thin paper.
Figure 12:
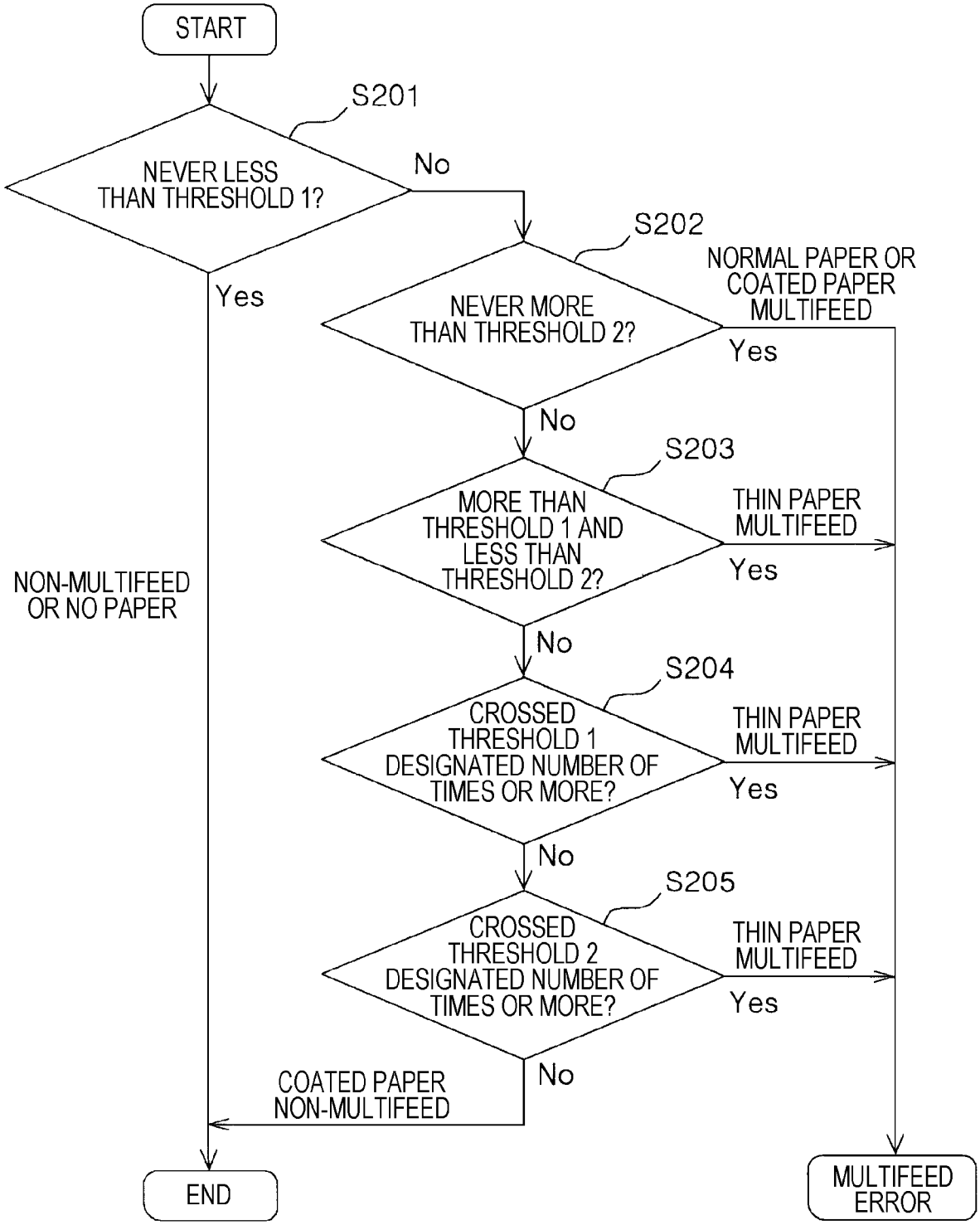
FIG. 12 is a flowchart showing a flow of multifeed judgment.

FIG. 11 is a graph showing an example of the relationship between the multifeed threshold and the detection intensity of each of coated paper, normal paper, and thin paper. FIG. 12 is a flowchart showing a flow of multifeed judgment.

Figure 13:
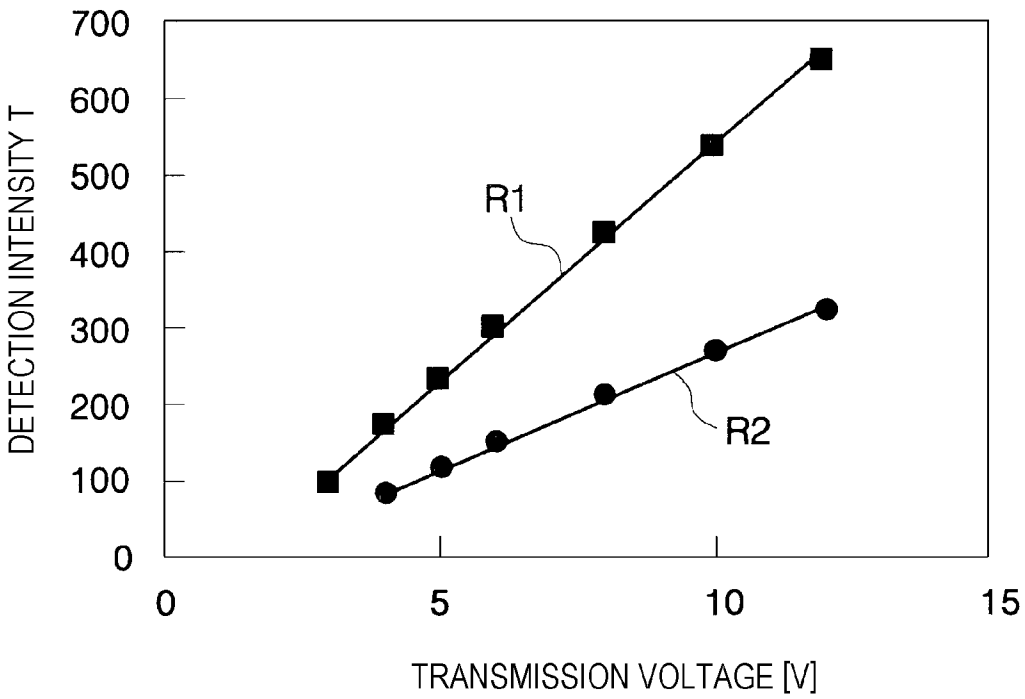
FIG. 13 is a graph showing the relationship between the detection intensity of multifeed detection and the transmission voltage.
Figure 14:
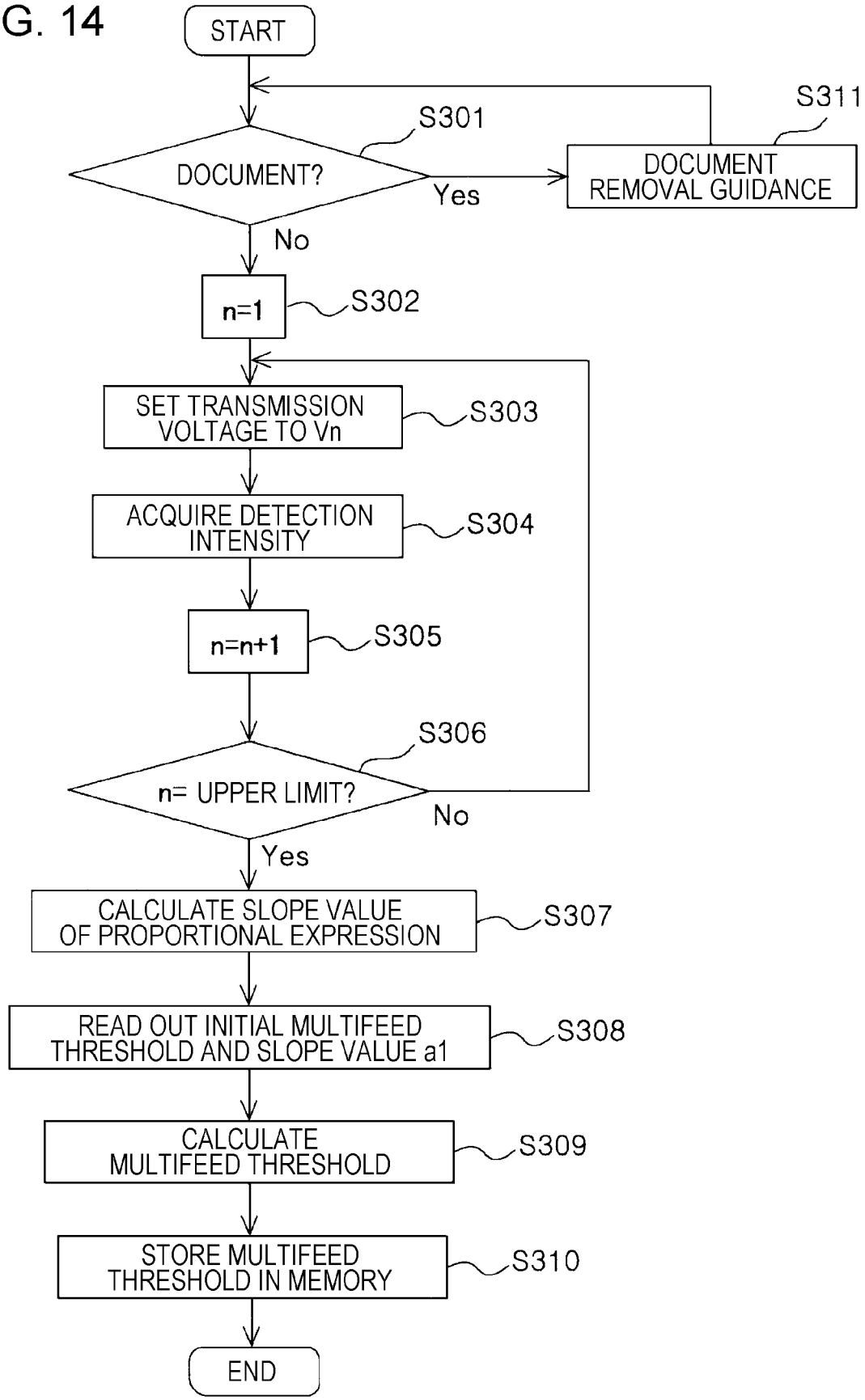
FIG. 14 is a flowchart showing the flow of the multifeed detection calibration.

FIG. 13 is a graph showing the relationship between the detection intensity of multifeed detection and the transmission voltage. FIG. 14 is a flowchart showing the flow of the multifeed detection calibration.

In the X-Y-Z coordinate system shown in FIGS. 1 to 4, the X direction is an apparatus-width direction and a document-width direction, and the Y direction is a document transport direction. The Z direction intersects with the Y direction, and is substantially orthogonal to a surface of a document to be transported. The +Y side is an apparatus front side, and the −Y side is an apparatus rear side. The +X side is a left side and the −X side is a right side when viewed from the apparatus front side. The +Z side is an apparatus upper side (including upper section, upper surface, and the like), and the −Z side is an apparatus lower side (including lower section, lower surface, and the like). The direction in which a document P is fed (+Y side) is named "downstream," and the side opposite thereto (−Y side) is named "upstream."

Overview of Scanner

A scanner 1 according to the invention is described below mainly with reference to FIGS. 1 and 2.

The scanner 1 includes an apparatus body 2 including a reader 20 (FIG. 3) that reads an image of a document P.

The apparatus body 2 includes a lower unit 3 and an upper unit 4. The upper unit 4 is attached to the lower unit 3 in an openable and closable manner about the downstream side thereof in the document transport direction as a rotation axis. Processing for a paper jam of a document P can be easily performed by rotating the upper unit 4 toward the apparatus front side to open the upper unit 4, and hence exposing a document transport path of the document P to the outside.

A medium placement part 11 having a placement surface 11*a* on which a document P to be fed is placed is provided on the apparatus rear side (−Y side) of the apparatus body 2. The medium placement part 11 is provided in an attachable and detachable manner to and from the apparatus body 2.

The medium placement part 11 is provided with a pair of left and right edge guides 12, 12 each having a guide surface 13 that guides a side edge in the width direction (x direction) that intersects with a feed direction (Y direction) of the document P.

The medium placement part 11 includes a first paper support 8 and a second paper support 9. The first paper support 8 and the second paper support 9 can be housed in the medium placement part 11 as shown in FIG. 2, and can be pulled out from the medium placement part 11 as shown in FIG. 1, so that the length of the placement surface 11*a* can be adjusted.

The apparatus body 2 includes an operation panel 7 on the apparatus front side of the upper unit 4. With the operation panel 7, various reading settings are made, operations for executing reading are made, and the contents of the reading settings and the like are displayed.

A feed port 6 continuous from the inside of the apparatus body 2 is provided in an upper section of the upper unit 4. The document P placed on the medium placement part 11 is fed toward the reader 20 provided in the apparatus body 2 through the feed port 6.

A paper output tray 5 (described later) is provided on the apparatus front side of the lower unit 3.

Document Transport Path in Scanner

Next, the document transport path in the scanner 1 is described with reference to FIG. 3. Note that a dotted line with reference sign T in FIG. 3 represents the document transport path.

A feed roller 14 that feeds the document P placed on the placement surface 11*a* of the medium placement part 11 toward the reader 20, and a separation roller 15 that nips the document P between the separation roller 15 and the feed roller 14 and separates the document P are provided downstream of the medium placement part 11.

The document P placed on the placement surface 11*a* of the medium placement part 11 is fed to the downstream side (+Y side) by the feed roller 14 rotatably provided relative to the lower unit 3. When a plurality of documents P are set on the medium placement part 11 in the scanner 1, the documents P are fed sequentially from the document P on the placement surface 11*a* side, to the downstream side.

A pair of transport rollers 16, the reader 20 that reads an image, and a pair of output rollers 17 are provided downstream of the feed roller 14. The document P which is nipped by the feed roller 14 and the separation roller 15 and fed to the downstream side is nipped by the pair of transport rollers 16, and is transported to the reader 20 located downstream of the pair of transport rollers 16.

An ultrasonic emitting unit 31 and an ultrasonic receiving unit 32 that configures a multifeed detection device 30 are provided in the document transport path between the feed roller 14 and the reader 20. More specifically, the multifeed detection device 30 includes the ultrasonic emitting unit 31 that emits an ultrasonic wave, and the ultrasonic receiving unit 32 that receives the ultrasonic wave emitted from the ultrasonic emitting unit 31 and outputs a detection signal corresponding to the received ultrasonic wave.

The multifeed detection device 30 includes, as components, a transmitting circuit 35, a receiving circuit 36, an analog-to-digital (A-D) converter 37, a controller 40 serving as a multifeed judgement unit, which are shown in FIG. 6 and described later in detail. In a first embodiment which is described later in detail, the multifeed detection device 30 also includes, as a component, the reader 20.

The ultrasonic emitting unit 31 and the ultrasonic receiving unit 32 are provided on the upper and lower sides with the document transport path interposed therebetween. More specifically, the ultrasonic emitting unit 31 is provided on the upper unit 4 side, and the ultrasonic receiving unit 32 is provided on the lower unit 3 side.

In this embodiment, the multifeed detection device 30 can detect multifeed of documents P to be transported, and a document P having a fold or a wrinkle. The configuration of the multifeed detection device 30 is described later in detail.

The reader 20 includes an upper reading sensor 20*a* provided on the upper unit 4 side, and a lower reading sensor 20*b* provided on the lower unit 3 side. In this embodiment, the upper reading sensor 20*a* and the lower reading sensor 20*b* each are configured as, for example, a contact image sensor module (CISM).

A document detector 47 that detects passage of the leading edge or the trailing edge of the document P is provided between the feed roller 14, and the ultrasonic emitting unit 31 and the ultrasonic receiving unit 32 in the document transport path. The controller 40 of the scanner 1 can recognize the position of the document P in the document transport path based on the signal transmitted from the document detector 47.

After an image on at least one of the front and rear surfaces of the document P is read by the reader 20, the document P is nipped by the pair of output rollers 17 located downstream of the reader 20, and is output through an output port 18 provided on the apparatus front side of the lower unit 3.

The lower unit 3 is provided with the paper output tray 5 that can be pulled out toward the apparatus front side from the output port 18. The paper output tray 5 can be in a state in which the paper output tray 5 is housed in a bottom section of the lower unit 3 (FIG. 1) and a state in which the paper output tray 5 is pulled out toward the apparatus front side (not shown).

In the state in which the paper output tray 5 is pulled out, the document P output from the output port 18 can be stacked on the paper output tray 5.

Control System

In FIG. 5, the controller 40 performs various control on the scanner 1. The controller 40 receives a signal input from the operation panel 7 (FIG. 1), and transmits a signal for controlling display of the operation panel 7 to the operation panel 7.

The controller 40 controls a feed-roller motor 45 and a transport-roller motor 46. The feed-roller motor 45 is a drive source of the feed roller 14 (FIG. 3). The transport-roller motor 46 is a drive source of the pair of transport rollers 16 (FIG. 3) and the pair of output rollers 17 (FIG. 3).

The controller 40 receives read data input from the reader 20, and transmits a signal for controlling the reader 20 to the reader 20.

The controller 40 receives signals input from a multifeed detection circuit 33 and the document detector 47. The controller 40 also transmits a signal required for control to the multifeed detection circuit 33. The multifeed detection circuit 33 represents a configuration obtained by eliminating the controller 40 from the multifeed detection device 30 shown in FIG. 6.

The controller 40 includes a central processing unit (CPU) 41, a read-only memory (ROM) 42, and a memory 43. The CPU 41 performs various calculation processing in accordance with a control program stored in the ROM 42, and controls the entire operation of the scanner 1. The memory 43 which is an example of a storage is a readable and writable non-volatile memory, and stores respective data required for multifeed detection (described later).

The controller 40 configures a multifeed judgment unit that judges occurrence of multifeed of documents P based on the detection signal transmitted from the multifeed detection circuit 33 and the respective data required for multifeed detection.

Multifeed Detection Unit

As described above, the multifeed detection device 30 includes the ultrasonic emitting unit 31 and the ultrasonic receiving unit 32. As shown in FIG. 3, the ultrasonic emitting unit 31 and the ultrasonic receiving unit 32 are arranged on the upper and lower sides to oppose each other with the document transport path T interposed therebetween.

The ultrasonic emitting unit 31 and the ultrasonic receiving unit 32 are arranged at the same position in the Y direction and oppose each other as shown in FIG. 3. The ultrasonic emitting unit 31 and the ultrasonic receiving unit 32 are also arranged at positions shifted from each other in the X direction as shown in FIG. 4, and provided such that the opposing surfaces thereof are inclined with respect to the X direction.

As shown in FIG. 6, the ultrasonic emitting unit 31 is connected to the transmitting circuit 35. The transmitting circuit 35 amplifies a pulse signal supplied from the controller 40, and supplies an ultrasonic pulse signal to the ultrasonic emitting unit 31. Thus, the ultrasonic emitting unit 31 emits an ultrasonic wave with a predetermined frequency based on the ultrasonic pulse signal whose signal has been amplified.

The intensity of the ultrasonic wave that is emitted by the ultrasonic emitting unit 31 is changeable under the control of the controller 40. The controller 40 changes the intensity of the ultrasonic wave, for example, by changing the voltage to be applied to the ultrasonic emitting unit 31 and hence changing the amplitude of the ultrasonic wave that is output from the ultrasonic emitting unit 31. Alternatively, the controller 40 changes the intensity of the ultrasonic wave by changing the driving pulse number of the ultrasonic emitting unit 31 and hence changing the number of times of emission of the ultrasonic wave that is output from the ultrasonic emitting unit 31.

The ultrasonic receiving unit 32 is connected to the receiving circuit 36. The receiving circuit 36 is an amplifying circuit, and amplifies the detection signal output from the ultrasonic receiving unit 32. The receiving circuit 36 is connected to the A-D converter 37 that converts the ultrasonic detection signal (analog signal) amplified by the receiving circuit 36 into a digital signal and outputs the digital signal as a voltage value to the controller 40. The digital signal output from the receiving circuit 36 to the controller 40 is an example of a detection signal output in accordance with the ultrasonic wave received by the ultrasonic receiving unit 32. Hereinafter, the intensity of the detection signal is referred to as "detection intensity S."

The receiving circuit 36 has a multi-amplifier configuration in which a plurality of amplifiers are connected in series and which amplifies the detection signal of the ultrasonic receiving unit 32. In this embodiment, four amplifiers 36*a*, 36*b*, 36*c*, and 36*d* are connected in series.

The last amplifier 36*d* is connected to the A-D converter 37. In addition, the output of each of the multiple amplifiers (36*a*, 36*b*, 36*c*) is input to the A-D converter 37.

The multiple amplifiers may have the same amplification factor, or different amplification factors.

FIRST EMBODIMENT OF MULTIFEED DETECTION CALIBRATION

A first embodiment of multifeed detection calibration is described below with reference to FIGS. 7 to 12.

In the following description, the relationship between the variation in the detection intensity of multifeed detection and the type of sheets is described first with reference to FIG. 7.

When a plurality of types of sheets are distinguished from one another in view of the basis weight, in general, a sheet having a small basis weight less attenuates the ultrasonic wave and results in a higher value of the detection intensity S as compared with a sheet having a relatively large basis weight. In FIG. 7, for example, the detection intensity S in a case where only one sheet A having a small basis weight is transported without multifeed (case of non-multifeed) is higher than the detection intensity S in a case where only one sheet B having a larger basis weight than the sheet A is transported without multifeed (case of non-multifeed).

Also, the detection intensity S when sheets A are fed in the case of multifeed is lower than the detection intensity S when a sheet A is fed in the case of non-multifeed.

The detection intensity S varies depending on various factors. A graph shown in FIG. 7 indicates that the detection intensity S may be V1 at maximum and V3 at minimum.

Such variations in the detection intensity S are roughly divided into two types of variations: variations resulting from the apparatus configuration (for example, a positional shift or angular shift between the ultrasonic emitting unit 31 and the ultrasonic receiving unit 32, a variation in feed voltage, a variation in characteristics of an electronic component, and the like); and variations resulting from the difference in air density under the use environment, or more specifically, a variation resulting from the difference in altitude (elevation) under the use environment.

The graph in FIG. 7 indicates that a sheet with a certain basis weight in a certain state (non-multifeed or multifeed) may exhibit a detection intensity S in the range from V1 to V3 when taking into account all the above-referenced variation factors. The range (degree) from V1 to V2 indicates the degree of variations resulting from the apparatus configuration, and the range (degree) from V2 to V3 indicates the degree of variations resulting from the altitude.

For example, the value V1 indicates a case where the detection intensity S is the highest at the altitude of 0 m (for example, a case where almost no positional shift or angular shift between the ultrasonic emitting unit 31 and the ultrasonic receiving unit 32 exists, the feed voltage is the highest, and the characteristics of the electronic component are those exhibiting the highest detection intensity).

The value V3 indicates a case where the detection intensity S is the lowest at the altitude of 3000 m (for example, a case where the positional shift or angular shift between the ultrasonic emitting unit 31 and the ultrasonic receiving unit 32 is the most noticeable, the feed voltage is the lowest, and the characteristics of the electronic component are those exhibiting the lowest detection intensity).

Then, if multifeed of sheets occurs, the detection intensity S is lowered due to an attenuation in ultrasonic wave. In FIG. 7, a sheet A exhibits the range on the rightmost side. When it is assumed that the use altitude is 0 m, by setting the multifeed threshold to Th1, [non-multifeed of sheet A], [non-multifeed of sheet B], and [multifeed of sheet A] can be correctly identified.

In contrast, a sheet B having a large basis weight exhibits a relatively low detection intensity S. If the use altitude increases, the detection intensity S of the sheet B becomes too close to, or occasionally overlaps the range of the detection intensity S when sheets A are multifed. Thus, [non-multifeed of sheet B] and [multifeed of sheet A] cannot be correctly identified.

When the apparatus is used at an altitude different from the altitude to which the initial multifeed threshold (in the example in FIG. 7, threshold Th1) can be applied, the multifeed threshold used in this case is required to be changed from the initial multifeed threshold. Specifically, the multifeed threshold is set to a lower value as the use altitude of the apparatus increases. The control that changes the multifeed threshold to a value suitable for the use altitude of the apparatus in this way is hereinafter referred to as multifeed detection calibration.

In this embodiment, the multifeed detection calibration is performed by using a calibration sheet Q shown in FIG. 8.

A sheet used for the calibration sheet Q is desirably a relatively thick sheet that exhibits a detection intensity S the maximum value of which (value V1 in FIG. 7) is relatively low so that the detection intensity S does not reach a saturation region.

While the detection intensity S changes by various factors as described above, a signal with a supply voltage or higher used in the receiving circuit 36 (FIG. 6) cannot be obtained. Thus, when the level of the signal received by the receiving circuit 36 reaches a certain level or higher, the level of the signal output from the receiving circuit 36 saturates. When a sheet that exhibits a relatively high detection intensity S (for example, normal paper or thin paper) is used, the detection intensity S may reach the saturation region, and as the result a proper multifeed threshold may not be calculated.

Thus, the calibration sheet Q desirably uses a relatively thick sheet that largely attenuates an ultrasonic wave by a certain degree.

The calibration sheet Q according to this embodiment has drawn thereon a sheet indication section 50 that allows the sheet to be visually recognized as a sheet for calibration, and a sheet-pass direction indication section 51 that allows a sheet-pass direction to be visually indicated. The sheet indication section 50 and the sheet-pass direction indication section 51 are drawn as shown in FIG. 8 for example.

In addition, an information indication section 52 is provided on the downstream side in the sheet-pass direction. In the information indication section 52, a bar code is indicated according to this embodiment.

The bar code includes at least first information that is information relating to adjustment for the multifeed threshold, and second information for specifying that the first information is the information relating to the adjustment for the multifeed threshold.

The first information includes an upper-limit detection value and a lower-limit detection value (described later) in this embodiment. The second information includes an identification code (for example, a combination of alphabetical and numerical characters) determined expediently.

The controller 40 can recognize that the transported sheet is the calibration sheet Q based on the second information by reading the information indication section 52 by using the reader 20, and as the result can recognize that the first information is the information relating to the adjustment for the multifeed threshold. Thus, the second information may be any information as long as the information is previously determined information (for example, "A123456"). Note that the second information is required to be previously stored as a reference value in the memory 43 (FIG. 5).

A flow of the multifeed detection calibration is described below with reference to a flowchart in FIG. 9.

The controller 40 can urge the user to execute the multifeed detection calibration shown in FIG. 9 (setting of the calibration sheet Q) at a predetermined timing. For example, at power-on or at recovery from power save mode, a message like "set calibration sheet and press OK button" can be displayed on the operation panel 7 (FIG. 1) to urge the user to set the calibration sheet Q.

Additionally or alternatively, for example, when a plurality of documents are transported and multifeed is continuously detected, the execution of the multifeed detection calibration can be urged similarly to the above.

When the controller 40 can judge that a sheet, which has the information indication section 52 within a predetermined range near the leading edge of the document and which is transported as the result of reading the information indication section 52 is a calibration sheet Q (Yes in step S101), the controller 40 advances to step S102. When the sheet is not the calibration sheet Q (No in step S101), the controller 40 executes normal scan operation (step S109).

Then, the first information (upper-limit detection value and lower-limit detection value) is acquired from the information indication section 52 of the calibration sheet Q, and stored in the memory 43 (FIG. 5).

The upper-limit detection value and the lower-limit detection value indicate the range within which the detection intensity S described above with reference to FIG. 7 may fall. The upper-limit detection value corresponds to the value V1 in FIG. 7, and the lower-limit detection value corresponds to the value V3 in FIG. 7. That is, the detection intensity S of the calibration sheet Q always falls within the range from the upper-limit detection value to the lower-limit detection value when the multifeed detection calibration is executed with any apparatus at any altitude (elevation).

The upper-limit detection value and the lower-limit detection value can be experimentally obtained by performing various tests in a manufacturing process. For example, the detection intensity S of the sheet configuring the calibration sheet Q is acquired by using multiple apparatuses with the same air density (altitude), a standard deviation ($\sigma$) is obtained, and the range regarding $2\sigma$ or $3\sigma$ can be set to the range from V1 to V2 shown in FIG. 7.

Alternatively, the detection intensity S is acquired while the air density under an installation environment of one apparatus is changed (for example, the altitude of 0 m to 3000 m), and the upper limit and the lower limit of the variation range of the detection intensity S can be set to V2 and V3 shown in FIG. 7.

That is, the range of the detection intensity S determined by the upper-limit detection value and the lower-limit detection value involves both a variation specific to the apparatus, and a variation resulting from the difference in air density (altitude), and the detection intensity S always falls within the range when measured with any apparatus at any altitude.

Then, the detection intensity S of the calibration sheet Q is acquired (step S103). That is, the ultrasonic emitting unit 31 emits an ultrasonic wave to the calibration sheet Q, the ultrasonic receiving unit 32 receives the ultrasonic wave, and thus the detection intensity S is acquired.

A wrinkle or deformation may likely occur in regions near the leading edge and the trailing edge of the sheet (ranges N in FIG. 8), and the detection intensity S may not be correctly acquired. Thus, the detection intensity S of the calibration sheet Q is desirably acquired in a region excluding the regions near the leading edge and the trailing edge of the sheet.

Then, it is determined whether the acquired detection intensity S is equal to or less than the upper-limit detection value, and is equal to or more than the lower-limit detection value (step S104). Consequently, if the acquired detection intensity S is more than the upper-limit detection value or less than the lower-limit detection value, it can be determined that a certain error occurs, and the process is ended in error (No in step S104). The error processing may include notification of an alert to the user.

Then, when the acquired detection intensity S is equal to or less than the upper-limit detection value, and is equal to or more than the lower-limit detection value (Yes in step S104), a detection sensitivity is calculated (S105).

The detection sensitivity is A1 or B1, or A1 and B1 shown in FIG. 10 according to this embodiment. That is, the detection sensitivity is a value (ratio) indicating the position between the upper-limit detection value and the lower-limit detection value of the detection intensity S of the calibration sheet Q.

In an example in FIG. 10, if a detection intensity of 500 is acquired when the detection intensity S of the calibration sheet Q whose upper-limit detection value is a detection intensity of 600 and lower-limit detection value is a detection intensity of 200 is acquired, A1:B1 is 1:3.

Then, the controller 40 acquires the maximum threshold and the minimum threshold from the memory 43 (FIG. 5) (step S106). The maximum threshold and the minimum threshold are values set in a manufacturing process and previously stored in the memory 43 (FIG. 5).

The maximum threshold and the minimum threshold are set in the manufacturing step by taking into account the type of sheets expected to be used and the variation in detection intensity S described above with reference to FIG. 7. The maximum threshold is the maximum value among expected multifeed thresholds, the minimum threshold is the minimum value among expected multifeed thresholds, and these values can be experimentally obtained in the manufacturing process similarly to the above-described upper-limit detection value and lower-limit detection value.

The controller 40 calculates a multifeed threshold based on the detection sensitivity acquired in step S105 (step S107). That is, the multifeed threshold is set to satisfy A1:B1=A2:B2 in FIG. 10. In the example in FIG. 10, when the upper-limit threshold is an intensity of 300 and the lower-limit threshold is an intensity of 100, A1:B1=A2:B2=1:3 is established, and thus the multifeed threshold to be set is an intensity of 250.

The acquired multifeed threshold is stored in the memory 43 (FIG. 5) (step S108).

The features of the scanner 1 are summarized as follows. A scanner 1 includes a multifeed detection device 30. The multifeed detection device 30 includes an ultrasonic emitting unit 31 that is arranged in a document transport path through which a document serving as an example of a medium is transported, and that emits an ultrasonic wave; an ultrasonic receiving unit 32 that is arranged to oppose the ultrasonic emitting unit 31 with the document transport path interposed therebetween, and that receives the ultrasonic wave emitted from the ultrasonic emitting unit 31; and a controller 40 serving as a multifeed judgment unit that judges occurrence of multifeed of documents based on a detection intensity S of the ultrasonic wave received by the ultrasonic receiving unit 32 and a multifeed threshold for judging multifeed of documents.

The scanner 1 further includes a reader 20 serving as an information acquisition unit that acquires first information that is information relating to adjustment for the multifeed threshold, and second information for specifying that the first information is the information relating to the adjustment for the multifeed threshold, from a calibration sheet Q holding the first information and the second information.

Thus, the multifeed detection calibration can be properly performed by using the calibration sheet Q under the user environment. The proper multifeed threshold corresponding to the user environment can be set and multifeed can be properly judged. In particular, since the calibration sheet Q holds the first information that is the information relating to the adjustment for the multifeed threshold and the second information for specifying that the first information is the information relating to the adjustment for the multifeed threshold, validity of the multifeed threshold acquired by the multifeed detection calibration can be ensured and proper multifeed judgment can be reliably performed.

Since the first information is a value specific to the calibration sheet Q. Even when the calibration sheet Q includes a plurality of different types of sheets, the first information is a value suitable for one of the different type of sheets, and hence the multifeed threshold can be properly set.

The controller 40 can acquire an upper-limit threshold that is an upper-limit value of the multifeed threshold, and a lower-limit threshold that is a lower-limit value of the multifeed threshold held in the memory 43 serving as a storage that stores information. The first information includes an upper-limit detection value that is an upper-limit value of the intensity of a detection signal, and a lower-limit detection value that is a lower-limit value of an intensity of the detection signal when the ultrasonic emitting unit 31 emits the ultrasonic wave while the calibration sheet Q is interposed between the ultrasonic emitting unit 31 and the ultrasonic receiving unit 32. The controller 40 determines a multifeed threshold by using the upper-limit threshold and the lower-limit threshold, based on a position between the upper-limit detection value and the lower-limit detection value of the intensity (detection intensity S) of the detection signal when the ultrasonic emitting unit 31 emits an ultrasonic wave while the calibration sheet Q is interposed between the ultrasonic emitting unit 31 and the ultrasonic receiving unit 32.

Thus, the multifeed threshold can be determined with a simple method. Since the upper-limit threshold and the lower-limit threshold is stored in the memory 43 serving as the storage of the multifeed detection device 30, even when the upper-limit threshold and the lower-limit threshold are adjusted depending on the situation (as the result, even when the multifeed threshold is set to be relatively high or low), the adjustment can be properly made.

When the detection intensity S falls outside the range from the upper-limit detection value to the lower-limit detection value (No in step S104 in FIG. 9), the controller 40 stops the processing and makes an alert. Thus, improper setting of the multifeed threshold and improper judgment based on the improper setting can be prevented.

When the controller 40 detects occurrence of multifeed of documents continuously a predetermined number of times, the controller 40 makes a notification of urging execution of the calibration processing using the calibration sheet Q. Thus, a detection failure (judgment of multifeed made although multifeed does not occur) resulting from the improper multifeed threshold is expected to be reduced.

The first information held in the calibration sheet Q is not limited to the upper-limit detection value and the lower-limit detection value, and other information for acquiring the multifeed threshold may be used.

For example, the range of the detection intensity S and the multifeed threshold corresponding thereto may be written, and a corresponding multifeed threshold based on the obtained detection intensity S may be acquired. In this case, the upper-limit threshold and the lower-limit threshold do not have to be held in the memory 43.

The information indication section 52 is bar code indication in the embodiment; however, it is not limited thereto. For example, information (numerical values) relating to the multifeed threshold may be directly written.

The judgment as non-multifeed can be made if the detection intensity S is equal to or more than the set multifeed threshold, and the judgment as multifeed can be made if the detection intensity S less than the multifeed threshold. However, the variation range of the detection intensity S when multifeed occurs may be large depending on the type of documents, and as the result erroneous detection may be made.

FIG. 11 is a graph showing the relationship between the threshold and the detection intensity S of each of "coated paper," "normal paper," and "thin paper." The vertical axis indicates the detection intensity, and the horizontal axis indicates the detection position (the detection position in the transport direction, in other words, the number of detection times) of each of the sheets. Note that the basis weights of sheets decrease in the order of "coated paper," "normal paper," and "thin paper."

In FIG. 11, when multifeed judgment is made by using a threshold 2, "normal paper non-multifeed" and "coated paper non-multifeed" can be distinguished from "normal paper multifeed. However, for "thin paper" having a smaller basis weight than normal paper, the variation range of the detection intensity S in case of multifeed is large, and the judgment as "thin paper multifeed" cannot be correctly made. Note that the variation range of the detection intensity S increases in the case of "thin paper multifeed," because a variation in the distance between sheets during multifeed decreases due to a wrinkle or deformation.

However, if the threshold is increased to avoid the above-referenced problem, and for example, the threshold is set to a threshold 1 in FIG. 11, "coated paper non-multifeed" and "normal paper multifeed" are no longer distinguished from each other.

Therefore, the controller 40 can perform the multifeed judgment by using both the two thresholds 1 and 2. More specifically, it is judged whether the detection intensity S has never been less than the threshold 1 as shown in FIG. 12 (step S201). If the detection intensity S has never been less than the threshold 1, the judgment is made as "non-multifeed" or "no paper" for any type of sheets (Yes in step S201).

Then, if the detection intensity S is less than the threshold 1 even once (No in step S201), it is judged whether the detection intensity S has never been more than the threshold 2 (step S202).

If the detection intensity S has never been more than the threshold 2 (Yes in step S202), the case is judged as multifeed of normal paper or coated paper (No in step S202). Although the case of coated paper multifeed is not shown in FIG. 11, the detection intensity S in the case of coated paper multifeed is lower than the detection intensity S in the case of normal paper multifeed.

Then, if the detection intensity S is more than the threshold 2 even once (No in step S202), it is judged whether the detection intensity S has been more than the threshold 1 and less than the threshold 2 (step S203). If the detection intensity S has been more than the threshold 1 and less than the threshold 2 (Yes in step S203), this represents a large variation range of the detection intensity S, and hence the case is judged as thin paper multifeed.

Then, if the detection intensity S has not more than the threshold 1 and less than the threshold 2 (No in step S203), it is judged whether the detection intensity S has crossed the threshold 1 a designated number of times (step S204). If the detection intensity S has crossed the threshold 1 the designated number of times (Yes in step S204), this represents a large variation range of the detection intensity S, and hence the case is judged as thin paper multifeed.

If the detection intensity S has not crossed the threshold 1 the designated number of times (No in step S204), it is judged whether the detection intensity S has crossed the threshold 2 a designated number of times (step S205). If the detection intensity S has crossed the threshold 2 the designated number of times (Yes in step S205), this represents a large variation range of the detection intensity S, and hence the case is judged as thin paper multifeed.

If the detection intensity S has not crossed the designated number of times (No in step S205), the case is judged as coated paper non-multifeed.

In this way, even when the variation range of the detection intensity S is large in the case where sheets having a small basis weight are multifed.

It is noted that "the designated number of times" in steps S204 and S205 can be changed, for example, by using the operation panel 7.

SECOND EMBODIMENT OF MULTIFEED DETECTION CALIBRATION

A second embodiment of multifeed detection calibration is described below with reference to FIG. 13 and later. In the second embodiment features absence of a calibration sheet.

The horizontal axis of FIG. 13 indicates the degree of voltage (transmission voltage) supplied from the transmitting circuit 35 (see FIG. 6) to the ultrasonic emitting unit 31 (that is, the intensity of an ultrasonic wave emitted from the ultrasonic emitting unit 31), and the vertical axis indicates a detection intensity T.

In FIG. 13, a plot with solid squares indicates a change in detection intensity when the transmission voltage is changed while a document is not present between the ultrasonic emitting unit 31 and the ultrasonic receiving unit 32 at the altitude of 0 m. A plot with solid circles indicates a change in detection intensity when the transmission voltage is changed while a document is not present between the ultrasonic emitting unit 31 and the ultrasonic receiving unit 32 at the altitude of 3000 m.

The detection intensity in this case differs from the above-referenced detection intensity S (the value obtained by digital conversion on the output of the last amplifier 36*d* included in the receiving circuit 36 (FIG. 6)), but is a value obtained by digital conversion on the output of an amplifier (for example, the amplifier 36*a*) located upstream of the last amplifier. Hereinafter, the detection intensity is referred to as "detection intensity T."

As shown in FIG. 13, it is found that the detection intensity T and the transmission voltage are proportional to each other within the range of predetermined transmission voltages, at any altitude.

It has been experimentally figured out that a slope value (hereinafter, referred to as "a1") of a proportional expression that determines a line R1 at the altitude of 0 m is twice a slope value (hereinafter, referred to as "a2") of a proportional expression that determines a line R2 at the altitude of 3000 m.

The slope value of the line can be calculated by using a method of typical regression analysis.

The slope value a1 of the proportional expression at the altitude of 0 m is held in the memory 43, the detection intensity T is acquired by changing the transmission voltage similarly to the above description as the multifeed detection calibration when the apparatus is actually used, and a slope value a is acquired. Thus, the altitude at which the apparatus is actually used can be obtained based on the slope value a1 at the altitude of 0 m. Then, the multifeed threshold can be changed based on the slope value a.

The multifeed detection calibration according to this embodiment is described below with reference to FIG. 14. The controller 40 can urge the user to execute the multifeed detection calibration shown in FIG. 14 at a predetermined timing, similarly to the multifeed detection calibration according to the first embodiment. For example, the multifeed detection calibration can be executed at power-on or at recovery from power save mode. Additionally or alternatively, the multifeed detection calibration can be executed when a plurality of documents are transported and multifeed is continuously detected.

The controller 40 determines whether a document is present in the document transport path, based on the detection signal of the document detector 47 (FIG. 3) (step S301). If a document is present (Yes in step S301), an alert such as "remove document" is displayed on the operation panel 7 (FIG. 1) (step S311). If a document is not present (No in step S301), a variable n indicating the number of acquisition times of the detection intensity T is set to 1 (step S302), the transmission voltage is set to Vn (step S303), and the detection intensity T is acquired (step S304).

Then, the variable n indicating the number of acquisition times of the detection intensity T is incremented (step S305), and it is determined whether the number of acquisition times of the detection intensity T has reached the upper limit (step S306). If the number of acquisition times of the detection intensity T has not reached the upper limit (No in step S306), step S303 and later steps are repeated. Note that the transmission voltage satisfies V1>V2>V3 . . . .

The upper-limit value of n is at least 2, and is desirably 3 or more. Also, the transmission voltage Vn is desirably in a range from about 3 [V] to 13 [V] as shown in FIG. 13. This is because if the transmission voltage is too high, the detection intensity T starts saturating.

Then, the controller 40 calculates the slope value (second slope value) a of the proportional expression, based on the plurality of acquired detection intensities T and the transmission voltage (step S307). Then, an initial multifeed threshold and an initial slope value a1 serving as "a first slope value" stored in the memory 43 (FIG. 5) are read out (step S308), and a multifeed threshold is calculated (step S309).

The initial multifeed threshold is, for example, a multifeed threshold suitable for the altitude of 0 m. The initial multifeed threshold is a numerical value of 250 as an example. Also, the initial slope value a1 is 60 as an example.

The multifeed threshold can be obtained as follows. [multifeed threshold]=[a/a1]x[initial multifeed threshold]

When the obtained slope value a is, for example, 30, a1=60 and a=30. In this example, the multifeed threshold is 125.

The controller 40 stores the calculated multifeed threshold in the memory 43 (FIG. 5).

The features of the scanner 1 are summarized as follows. The memory 43 (FIG. 5) serving as a storage stores a first slope value (a1) acquired while a document is not present between the ultrasonic emitting unit 31 and the ultrasonic receiving unit 32 under an environment to which an initial multifeed threshold is applied. The controller 40 can execute a calibration mode that acquires a second slope value (a) while a document is not present between the ultrasonic emitting unit 31 and the ultrasonic receiving unit 32 under a use environment. The initial multifeed threshold is changed to a multifeed threshold based on a ratio of the slope value a1 to the slope value a.

That is, the multifeed threshold is determined not based on only a single ultrasonic intensity (detection intensity T), but the multifeed threshold is determined based on a plurality of ultrasonic intensities. Thus, reliability of the corrected multifeed threshold is increased and more proper multifeed judgment can be performed.

With the receiving circuit 36 (FIG. 6) in which the plurality of amplifiers are connected in series, the intensity of the detection signal output from the last amplifier 36*d* (FIG. 6) among the plurality of amplifiers saturates due to amplification, and a proper slope value a may not be acquired. Therefore, according to this embodiment, the controller 40 acquires the slope value a based on the detection signal transmitted from an amplifier (for example, amplifier 36*a*) located upstream of the last amplifier among the plurality of amplifiers, and thus the proper slope value a can be acquired.

In this embodiment, the multifeed threshold may have an upper-limit value and a lower-limit value. In this case, the lower-limit value is desirably a value larger than a possible noise region of the receiving circuit 36. That is, even when the transmitting circuit 35 is not in operation, the receiving circuit 36 generates a certain detection output. Thus, the lower-limit value of the multifeed threshold is desirably larger than the certain detection output.

Furthermore, if the acquired multifeed threshold falls outside the range from the upper-limit value to the lower-limit value, retry may be made, or an error notification may be made.

The multifeed threshold does not have to be acquired by changing the initial multifeed threshold, and may be acquired by changing the initial multifeed threshold only when a predetermined condition is satisfied.

While the above-described multifeed detection device 30 is applied to a scanner as an example of an image reading apparatus, the multifeed detection device 30 can be applied to a recording apparatus including a recording device that performs recording on a medium, for example, a printer. With such a configuration, for example, when the second embodiment is applied to the above-described multifeed detection calibration, the reader 20 shown in FIG. 3 may be configured as a recording unit that performs recording on a medium.

In the second embodiment of the above-described multifeed detection calibration, the acquired slope value a and the slope value a1 stored in the memory 43 are used for calculating the multifeed threshold. However, taking into account that the slope value a1 stored in the memory 43 is the value at the altitude of 0 m, the use altitude of the apparatus can be obtained by the following expression.

$$[\text{altitude}]=-6000\times[a/a1]+6000$$

For example, with an ink jet printer, the ejection performance of ink decreases when the altitude increases. Thus, the ejection strength at ejection of ink may be desirably switched based on the altitude obtained by calculation.

With the image reading apparatus, without limiting to the recording apparatus, a temperature rise of a component becomes noticeable as the altitude increases. Therefore, by controlling the driving speed of a movable element (for example, a carriage with an ink jet recording head mounted, or a roller that transports a medium), or by performing intermittent operation (decreasing the speed as the altitude increases) in accordance with the altitude, the temperature rise of the component of the apparatus can be suppressed.

The entire disclosure of Japanese Patent Application No. 2017-165693, filed Aug. 30, 2017 is expressly incorporated by reference herein.

What is claimed is:

1. A multifeed detection device, comprising:

an ultrasonic emitting unit that is arranged in a medium transport path through which a medium is transported, and that emits an ultrasonic wave;

an ultrasonic receiving unit that is arranged to oppose the ultrasonic emitting unit with the medium transport path interposed therebetween, and that receives the ultrasonic wave emitted from the ultrasonic emitting unit;

a multifeed judgment unit that judges occurrence of multifeed of media based on a detection intensity of the ultrasonic wave received by the ultrasonic receiving unit, and a multifeed threshold for judging multifeed of media; and an information acquisition unit that acquires first information that is information relating to adjustment for the multifeed threshold, and second information for specifying that the first information is the information relating to the adjustment for the multifeed threshold, from a calibration sheet holding the first information and the second information, wherein the multifeed judgment unit is configured to acquire an upper-limit threshold that is an upper-limit value of the multifeed threshold, and a lower-limit threshold that is a lower-limit value of the multifeed threshold held in a storage that stores information, wherein the first information includes an upper-limit detection value that is an upper-limit value of the detection intensity, and a lower-limit detection value that is a lower-limit value of the detection intensity when the ultrasonic emitting unit emits an ultrasonic wave while the calibration sheet is interposed between the ultrasonic emitting unit and the ultrasonic receiving unit, and wherein the multifeed judgment unit determines the multifeed threshold by using the upper-limit threshold and the lower-limit threshold, based on a position between the upper-limit detection value and the lower-limit detection value of the detection intensity when the ultrasonic emitting unit emits the ultrasonic wave while the calibration sheet is interposed between the ultrasonic emitting unit and the ultrasonic receiving unit.

2. The multifeed detection device according to claim 1, wherein the multifeed judgment unit stops processing and makes an alert when the detection intensity falls outside a range from the upper-limit detection value to the lower-limit detection value.

3. An image reading apparatus, comprising:

a reading device that reads a surface of a medium; and the multifeed detection device according to claim 1.

4. A multifeed detection device, comprising:

an ultrasonic emitting unit that is arranged in a medium transport path through which a medium is transported, and that emits an ultrasonic wave;

an ultrasonic receiving unit that is arranged to oppose the ultrasonic emitting unit with the medium transport path interposed therebetween, and that receives the ultrasonic wave emitted from the ultrasonic emitting unit;

a multifeed judgment unit that judges occurrence of multifeed of media based on a detection intensity of the ultrasonic wave received by the ultrasonic receiving unit, and a multifeed threshold for judging multifeed of media; and an information acquisition unit that acquires first information that is information relating to adjustment for the multifeed threshold, and second information for specifying that the first information is the information relating to the adjustment for the multifeed threshold, from a calibration sheet holding the first information and the second information, wherein, when the multifeed judgment unit detects multifeed of media continuously a predetermined number of times, the multifeed judgment unit makes a notification of urging execution of calibration processing using the calibration sheet.

* * * * *